US007500800B2

(12) United States Patent
Hughes et al.

(10) Patent No.: US 7,500,800 B2
(45) Date of Patent: Mar. 10, 2009

(54) METHOD OF CHARGING AND DISTRIBUTING PARTICLES

(75) Inventors: John Farrell Hughes, Southhampton (GB); Karen Louise Baxter, Salisbury (GB); Malcolm Tom McKechnie, Hull (GB)

(73) Assignee: Reckitt Benckiser (UK) Limited, Slough, Berkshire (GB)

( * ) Notice: Subject to any disclaimer, the term of this patent is extended or adjusted under 35 U.S.C. 154(b) by 0 days.

(21) Appl. No.: 10/496,362

(22) PCT Filed: Nov. 27, 2002

(86) PCT No.: PCT/GB02/05353

§ 371 (c)(1),
(2), (4) Date: Aug. 18, 2004

(87) PCT Pub. No.: WO03/045217

PCT Pub. Date: Jun. 5, 2003

(65) Prior Publication Data

US 2005/0039677 A1 Feb. 24, 2005

(30) Foreign Application Priority Data

Nov. 27, 2001 (GB) ..... 0128408.2

(51) Int. Cl.
*B05C 19/04* (2006.01)

(52) U.S. Cl. ..... 401/200

(58) Field of Classification Search ..... 401/200, 401/283, 291, 280, 281, 261–263, 265, 266; 132/317; 118/629, 621
See application file for complete search history.

(56) References Cited

U.S. PATENT DOCUMENTS

| | | | | | |
|---|---|---|---|---|---|
| 1,612,593 | A * | 12/1926 | MacDougall | 401/200 |
| 2,317,662 | A * | 4/1943 | Zimmerman | 401/200 |
| 4,342,522 | A * | 8/1982 | Mackles | 401/200 |
| 4,730,751 | A * | 3/1988 | Mackles et al. | 222/211 |
| 4,944,625 | A * | 7/1990 | Futter et al. | 401/270 |
| 6,033,486 | A | 3/2000 | Andros | 134/6 |
| 6,138,671 | A | 10/2000 | Noakes et al. | 128/202.25 |
| 6,406,206 | B1 * | 6/2002 | Girardot et al. | 401/266 |
| 6,805,510 | B2 * | 10/2004 | Lee | 401/200 |

FOREIGN PATENT DOCUMENTS

| | | |
|---|---|---|
| GB | 2 328 862 | 10/1999 |
| WO | WO 96/10459 | 4/1996 |

OTHER PUBLICATIONS

Search Report from The Patent Office in Great Britain for Application No. GB 0227576.6 dated Mar. 26, 2003.
WPI abstract accession No. 1987-195326 [28] & JP62124284A—May 6, 1987 [Anelva]—see also PAJ abstract.
International Search Report for PCT/GB02/05353 Mar. 18, 2003.

* cited by examiner

*Primary Examiner*—David J Walczak

(57) ABSTRACT

A powder charging and delivery device which comprises a receptacle having a neck portion, the receptacle containing particles of a material which can be electrostatically charged and the receptacle having a reticulated, open pore, foam material disposed within the neck thereof, whereby as the particles are dispensed from the container they travel through the pores of the reticulated foam material and thereby become electrostatically charged.

13 Claims, 4 Drawing Sheets

METHOD OF CHARGING AND DISTRIBUTING PARTICLES

The present invention relates to a method of charging and distributing particles and, in particular, to a method of electrostatically charging and distributing small particles without the need for an external energy source.

It is well known that charge reorganisation occurs when the surfaces of two different materials come into contact. Following static or dynamic contact, the surfaces will exhibit an equal and opposite level of charge. The polarity and level of charge will be determined primarily by the relative positions of the materials in the Tribo series. It is normal for the magnitude of charge exchange to be directly proportional to the degree of friction between the two surfaces and/or the number of contacts. GB-A-2328862 discloses a method for controlling and removing dust and other fine particles in a material, such as a carpet or fine fabric material, in which carrier particles are electrostatically charged to give the carrier particles a minimum charge to mass ratio of $\pm 1\times10^{-4}$ C/kg, delivered to the material whereby the dust and other fine particles in the material agglomerate with the charged particles and removing the resultant agglomerates from the material. As described in GB-A-2328862 the charging of powder was achieved by maximising the level of friction between the powder and the internal surface of a long narrow delivery tube. This necessitated delivering the powder in a high velocity air flow, which was accomplished by manually squeezing the flexible powder container. This technique was capable of charging the powder to a value of approximately $10^{-4}$ C/kg.

Although an efficient charging method, this system proved impractical on three accounts. First, the level of charging necessitated the added complication of micro perforations in the wall of the charging delivery tube. This was necessary in order to facilitate the electrostatic reconditioning of the inner wall of the tube. Secondly, in order to achieve the high level of charging, considerable physical effort was required by the user by way of squeezing the applicator by hand. Thirdly, the narrow charging and delivery tube was incapable of delivering powder easily and effortlessly over a wide area.

Therefore, an alternative charging and delivery method is required in order to provide a practical charge-on-delivery hand-held powder delivery system.

Accordingly the present invention provides a powder charging and delivery device which comprises a receptacle having a neck portion, the receptacle containing particles of a material which can be electrostatically charged and the receptacle having a reticulated, open pore, foam material disposed within the neck thereof, whereby as the powder is dispensed from the container it travels through the pores of the reticulated foam material and thereby becomes electrostatically charged.

By "reticulated, open pore, foam material" we mean that there are interconnected pathways through the foam, the pathways being curved, preferably serpentine, and most preferably highly tortuous. The particles become electrostatically charged in travelling through the pathways.

The electrostatically charged carrier particles are preferably powder particles formed from mineral, polymeric, wax or plant fibre materials; more preferably from celite, maize, cyclodextrin, polyvinylpyrrolidone, polyester, nylon, calcium carbonate (calcite), sodium bicarbonate, sodium carbonate, sodium sesquicarbonate, polyvinyl chloride (PVC), polytetra fluoroethylene, polystyrene, polycarbonate, polyimides, "immobilised tannic acid" (as defined below) and wax materials (such as synthetic paraffin wax or a natural wax, for example Carnauba wax).

By the term "immobilised tannic acid" as used herein is meant tannic acid immobilized on carrier particles, preferably polymeric beads, most preferably polyvinyl-pyrrolidone beads.

Mineral powders such as calcium carbonate, sodium bicarbonate, sodium carbonate and sodium sesquicarbonate may be coated in an oil, such as a fragranced oil. Where the powder is coated in oil the percentage of oil to powder will be in the range of from 0.1% to 2% by weight. At a level of below 0.1% by weight uniform coating of the power is not achieved, whilst at a level of above 2% by weight the powder becomes too wet and loses its free flowing characteristics.

The minimum level of charging required on the carrier particles is generally such as to provide a charge to mass ratio of $\pm 1\times10^{-5}$ C/kg, although ratios in excess of $\pm 1\times10^{-4}$ C/kg may be achieved using the charging and delivery system of the invention.

The electrostatic charge on the carrier particle may be of positive or negative polarity, or may be a mixture of both when the particles are frictionally charged mixtures of different electrically insulating materials.

The charged particles used in the method of the invention preferably have a mean particle size in the range of from 50 to 500 μm, more preferably 100 to 200 μm, depending upon the density of the particles. Mean particle size is determined by repeated sampling of the diametrical span of the particles, in different, random orientations. Coated or uncoated mineral powders are generally preferred as they are fairly dense particles. Although polymer powders charge well against the foam they do not flow through the foam as well as they are less dense.

In a particularly preferred aspect of the present invention, the particles may be coated with an allergen denaturing composition. This aspect of the present invention is of importance when the charged particles are to be used in the cleaning or treatment of carpets, curtains, household furnishings and the like. It is believed that the faeces of the house dust mite (*Dermatophagoides pteronyssinus* Der-p and *Dermatophagoides farinae*—Der-f)trigger the immune response of the body, thereby giving rise to well known allergenic symptoms. Other allergens which are problematic are cat allergens (Fel-d) and cockroach allergens (Bla-q). Allergen denaturant compositions which denature these allergens are known in the art. Allergen denaturants which may be used in the present invention include, but are not limited to, an oil comprising one or more terpene hydrocarbon, cajeput oil (tea tree oil), immobilised tannic acid, 6-isopropyl-m-cresol, diazolidinyl urea, anionic sodium dioctyl sulphosuccinimide, aluminium chlorohydrate or parsley oil (apiol). The preferred allergen denaturant with which the particles of the present invention may be coated is tea tree oil.

The receptacle will generally be provided either with a reusable cap or a peel off seal. Receptacles with a reusable cap may be used more than once and may be designed to be refilled with powder, whereas receptacles with a peel off seal are generally intended for single use.

The reticulated foam material which is contained within the receptacle is preferably made of polyether, polyester or polyurethane. Such foams may contain a carbon loading (i.e. be carbonised) although this will generally reduce the charge obtained on the powders.

The pore size of the reticulated foams is generally within the range of from 20 to 65 ppi (pores per inch); 8 to 26 ppcm (pores per centimeter). Whilst the larger pore sizes (e.g. 20 to 30 ppi; 8 to 12 ppcm) allow a greater flow of the powder through the foam, the number of contacts with the foam is reduced, thereby resulting in a lower charging of the powder than is achieved with foams of a smaller pore size (e.g. 45 to 65 ppi; 19 to 28 ppcm).

The length of the reticulated foam within the receptacle can be varied in order that a desired charge to mass ratio (q/m) is achieved. Generally the length of the reticulated foam will be in the range of from 50 to 300 mm in order to provide a path through the foam of an appropriate length in order to achieve charging of the particles to the desired degree.

It will be understood that the choice of powder material (optionally coated with oil), foam material, foam length and pore size must be optimised in order to achieve a high charge-to-mass ratio.

An additional aspect of the present invention is that the powder may comprise a mixture of at least two different powdered materials which, on charging as described herein, will accept charges of opposite polarity. This system may be termed a bipolar system.

It will be understood that the use of such a mixture of charged particles has particular advantages in controlling and removing dust and other fine particles in a material, for example, a carpet. This is because, in practice, the dust particles will either themselves be naturally charged and will be attracted to particles of the opposite polarity and/or will be polarised when in close proximity to the dispensed charged particles thus also effecting attraction and agglomeration.

The present invention will be further described with reference to the accompanying drawings, in which.

Figure 1:
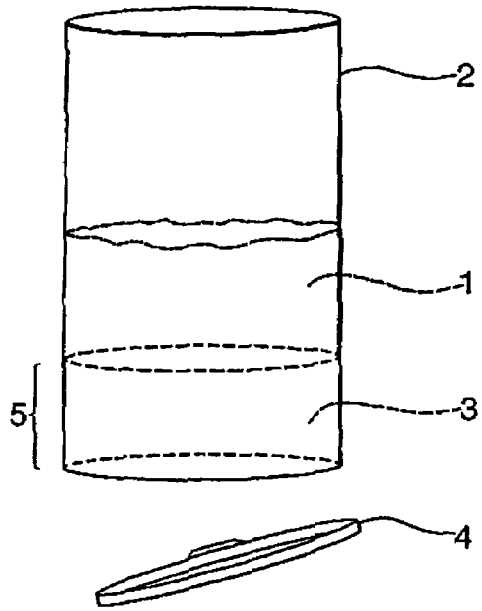
FIG. 1 is a schematic illustration of a powder charging and delivery device of the present invention.

Referring to FIG. 1, the powder charging and delivery device of the present invention comprises a powder product 1 which is contained in a flexible or rigid receptacle 2. A reticulated, open pore, foam material 3 is contained within the neck portion 5 of the receptacle. The receptacle is fitted with a reusable cap or a peel-off seal 4.

To use the dispenser the seal or cap is removed and the receptacle is inverted and gently shaken to dispense its contents. The tumbling action of the powder through the pores of the foam insert ensures numerous and repeated particle/foam contacts, thus allowing the particles to become electrostatically charged prior to completely vacating the dispensing package. In Example 1, the level of charge achieved on a sample powder with a polyether foam of 65 ppi was approximately $4.5\times10^{-5}$ C/kg. Although this level of charge was less than the $10^{-4}$ C/kg level achieved in GB-A-2328862 referred to earlier, it proved sufficient to enhance the dust and allergen removal characteristics from a carpet when compared to uncharged powder.

The dispersal of the powder onto a flat surface was more even than a standard non-charging dispenser due to the mutual repulsion of the unipolar charged particles and the sieving effect of the foam. Dispensing required a minimal effort by the user since only gentle shaking of the dispenser was required to charge and dispense the powder particles. The improved powder dispersal enabled superior dust and allergen removal to be achieved.

The present invention will be further described with reference to the following Examples.

EXAMPLE 1

Method

The powder used in the tests was formulated from calcium carbonate powder coated with lavender fragranced oil. The particles were in the range of from 100 to 200 μm in mean particle size. The formulation had a resistivity of $2.5\times10^{9}$ Ohm meters.

The standard dispenser was a cylindrical plastic container 250 mm in height and 55 mm in diameter. The cap was also plastic with a resealable hole 10 mm in diameter. When the powder was dispensed through this dispenser its charge-to-mass ratio was $+1\times10^{-7}$ C/kg.

The simple tribocharging delivery system developed is shown schematically in FIG. 1. The modified dispenser was 250 mm in height and 80 mm diameter. The reticulated foam used for this experiment was polyether, 65 ppi (28 ppcm), 50 mm in length. When the test powder was shaken through this length of foam the charge to mass ratio achieved was $+4.5\times10^{-5}$ C/kg. The powder released from the modified container was evenly dispersed over the carpet surface due to mutual repulsion of the unipolar charged particles and the sieving effect of the foam. This brought the particles into close contact with dust within the carpet fibres.

Carpet samples were cut to size (295 mm×320 mm) and vacuum cleaned to remove loose fibres and particles. Tests were completed on fabric backed, tufted polypropylene carpet (Tompkinsons Carpets Ltd).

Test Protocol

House dust was collected from domestic vacuum cleaner bags and sieved to below 53 μm mean particle size. A carpet sample was weighed and 1.5 g±0.02 g of dust was applied evenly to the carpet sample through a small sieve. The dust was lightly worked into the carpet pile with a hard bristle brush. The carpet sample and dust combination was weighed. For tests where powder was applied to the carpet, the carpet sample was placed on the floor and 6.00 g±0.3 g of powder was applied evenly over the carpet sample from a height of 1 meter. The carpet sample was clamped on to a motorised platform. The motorised platform oscillated under a stationary vacuum cleaner head attached to a vacuum cleaner (AEG Vampyre 2000). This provided a repeatable way of vacuum cleaning the carpet. The motorised platform and the vacuum cleaner were simultaneously switched on. The platform oscillated twice, then it and the vacuum cleaner were switched off. The carpet sample was removed from the platform and reweighed. Tests were completed at 40% humidity. Six replicates were completed with dust and either charged or uncharged powder applied.

Additional tests were completed using the same method as above without the addition of dust. These "powder alone" tests measured the amount of charged or uncharged powder remaining in each carpet sample after vacuum cleaning. Assuming this proportion stayed constant in the combined dust and powder tests, these values were then used to calculate the amount of dust retained in the carpet after vacuum cleaning in these tests.

Tests were also completed using the above protocol but applying dust alone to the carpet with no addition of powder. These measured the amount of dust expected to be removed from the carpet when no carpet powder was added. Six replicates were completed on each carpet material.

Figure 2:
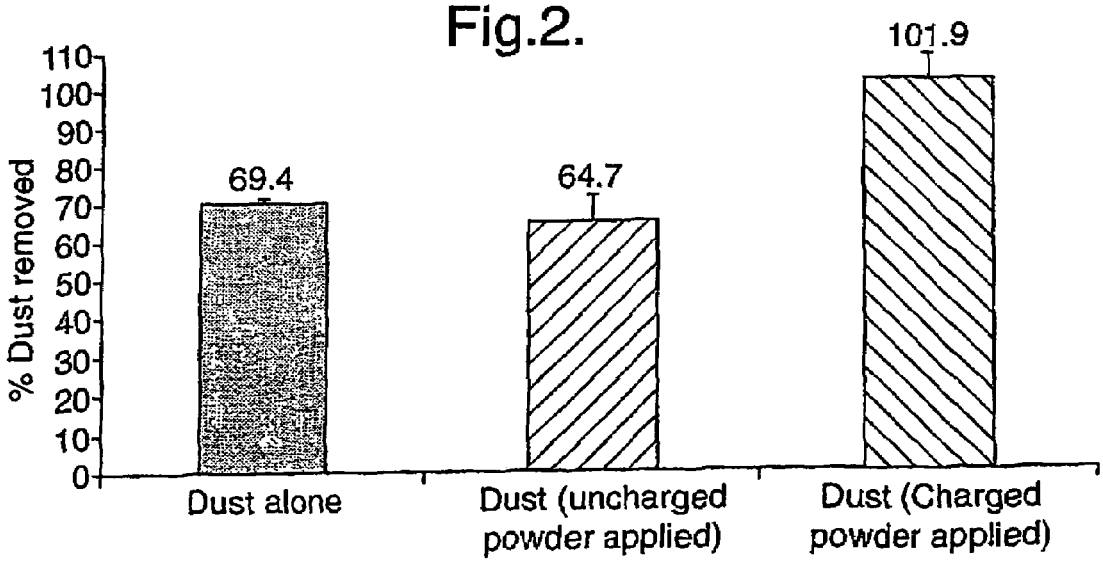
FIG. 2 illustrates the percentage of dust removed from carpet samples with and without powder applied as described in Example 1.
Figure 3:
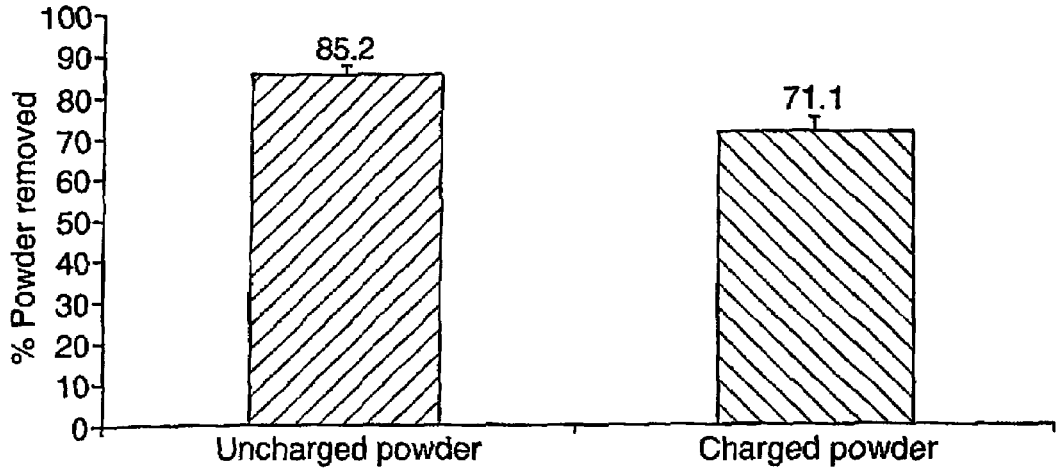
FIG. 3 illustrates the percentage of powder removed from carpet samples as described in Example 1.

The results of the tests are shown in FIGS. 2 and 3. FIG. 2 illustrates the percentage of dust removed from the polypropylene carpet samples with and without powder applied. FIG. 3 illustrates the percentage of powder removed from the polypropylene carpet samples.

Measurement of the carpet mass before and after vacuum cleaning allowed the calculation of the mass of dust removed in each test. The powder was applied to the carpet without the pre-application of dust to assess the retention of powder in the carpet. It was assumed that the mass of powder retained on the carpet remained the same when dust had also been applied. The mass of powder assumed to be retained in the carpet was taken into account where dust and powder were both applied, to calculate only the mass of the dust retained. The data was converted to the percentage of the dust originally applied that was removed from the carpet as illustrated in FIG. 2.

Results

FIG. 2 shows that when no powder was applied to the carpet 69.4% (standard error 1.6%) of the dust was removed by vacuuming using the above method. This was increased significantly to 101.9% (standard error 6.6%) when charged powder was applied to the carpet. This shows that within the experimental error margins there was almost complete removal of dust from the carpet when the charged powder was applied. The amount of dust removed from the carpet when uncharged powder was applied (64.7% standard error 7%) was not significantly different to the dust alone tests.

FIG. 3 shows that 85.2% (standard error 2.2%) of the uncharged powder was removed from the carpet by vacuuming. The amount of charged powder removed was significantly lower than this (71.1%, standard error 3.6%), which was probably due to impedance by electrostatic attraction to the carpet fibres.

Discussion

The results indicate that there was a statistically significant increase in the amount of dust removed from a carpet during vacuum cleaning when a charged powder was applied. The magnitude of the increase in dust removal when a charged powder was applied to polypropylene carpet was on average 32.5% as compared to dust alone tests. The measured effect is thought to be due to the electrostatic attraction and agglomeration of dust particles around the powder particles, allowing the dust to be removed more easily.

When the charged powder alone was applied to the carpet, significantly less charged powder was removed as compared to the uncharged powder. This suggests that powder retention is due to the electrostatic attraction of the charged powder to the carpet fibres.

Under these test conditions, more charged than uncharged powder stayed in the carpet after vacuum cleaning. This could offer a consumer advantage, as any fragrance carried by the powder particles might last longer in the room. The tests were carried out with just two oscillations of the vacuum cleaner head over the carpet samples. However it is likely that more vigorous cleaning of a carpet would be completed in the home. Therefore, the difference in retention of charged and uncharged powder in the carpets would probably be greatly reduced, if not eradicated.

EXAMPLE 2

Figure 4:
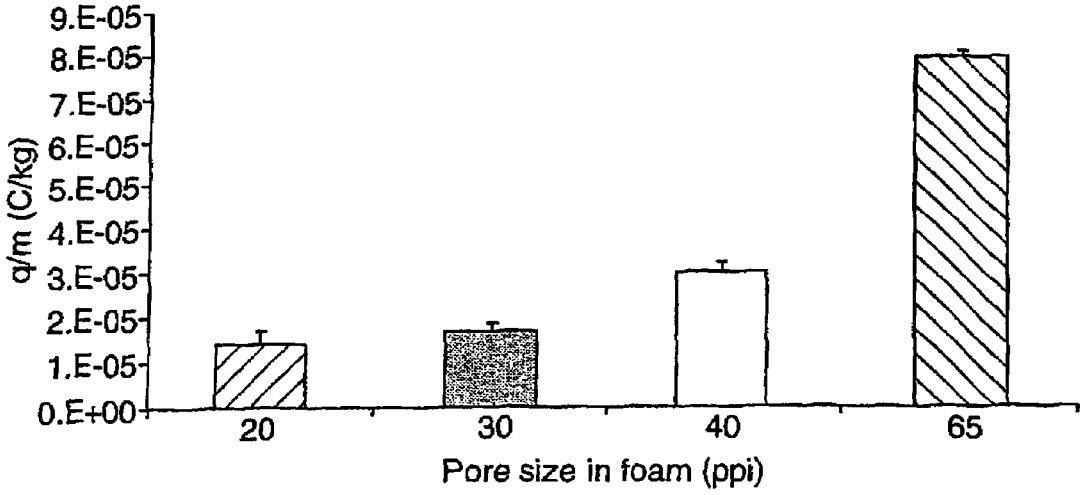
FIG. 4 illustrates the effect of the pore size of the foam on the electrostatic charge of a coated calcite powder.

In order to investigate the effect of the pore size of the foam on the electrostatic charge achieved on calcite powder having a mean particle size in the range of 100 to 200 μm coated with 1% lavender oil, the powder was distributed through polyurethane foam 50 mm in length having pore sizes of 20, 30, 40 and 65 ppi (8, 12, 16, 28 ppcm). The 40 ppi (16 ppcm) foam contained carbon. The results are given in FIG. 4.

EXAMPLE 3

Figure 5:
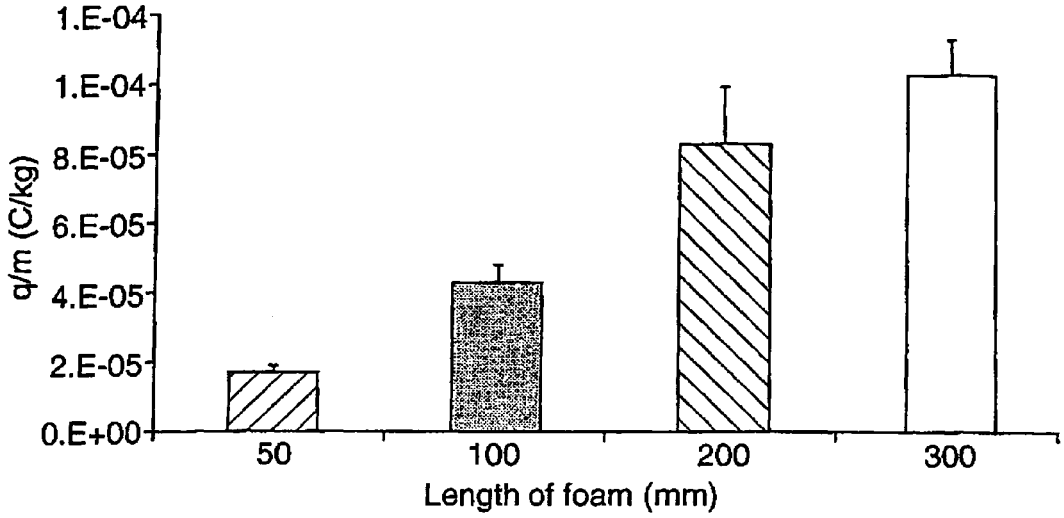
FIGS. 5 and 6 illustrate the effect of foam length on the electrostatic charge of a coated calcite powder.

The length of the foam in the receptacle of FIG. 1 was varied. Calcite powder having a mean particle size in the range of 100 to 200 μm coated with 1% lavender oil was distributed though a polyurethane foam having a pore size of 30 ppi (12 ppcm). The lengths of the foam tested were 50, 100, 200 and 300 mm. The electrostatic charges achieved on the powder are recorded in FIG. 5.

Figure 6:
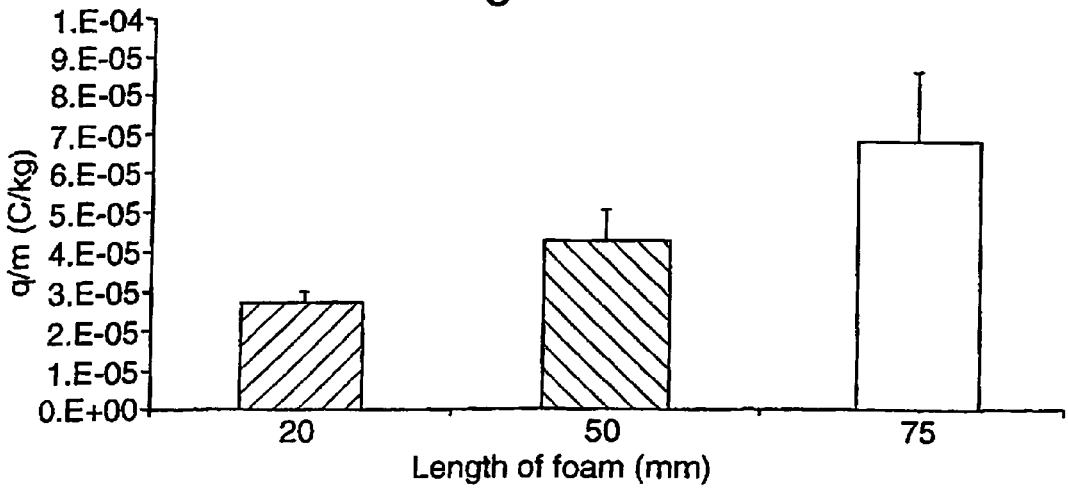

A similar result was obtained using different lengths of a polyurethane foam having a pore size of 65 ppi (28 ppcm). The electrostatic charges achieved on the powder are recorded in FIG. 6.

EXAMPLE 4

Calcite powder was coated with 1% w/w of tea tree oil. The powder had a resistivity of $2.6\times10^{10}$ Ohm meters.

The charge to mass ratio achieved on the powder when it was dispersed from the standard dispenser described in Example 1 was $1.1\times10^{-7}$ C/kg, whilst when the powder was dispensed from the delivery system shown in FIG. 1 it was $2.23\times10^{-4}$ C/kg.

The test protocol described in Example 1 was repeated using dust aliquots of 1 g±0.05 g. To mimic the humidity expected to be found where a thriving house dust mite colony survives, all tests were carried out at 80% RH.

Six replicates were conducted of:

Dust alone control

Dust+Charged 1% w/w Tea Tree Oil powder dispensed from the charging pack of the invention Dust+Uncharged 1% w/w Tea Tree Oil powder dispensed from the standard product pack.

Dust Alone Control

After the collection of the pre-treatment control dust sample, the carpet samples were left at 80% RH for 3.5 hours. The remaining dust was then collected in the same way.

Dust with 1% w/w Tea Tree Oil Powder Tests

The carpet samples were weighed after collection of the pre-treatment control samples.

Charged carpet powder was dispensed from the charging pack onto the remaining dusty area of each of the 6 replicate carpet samples. This was screened with a frame to ensure that all of the powder added to the carpet alighted on this area. The carpet was then re-weighed and the weight of added powder recorded. An average of 2.16 g (standard error 0.092 g) of Tea Tree Oil powder was dispensed in the charged powder tests.

In the uncharged powder tests an average of 2.07 g (standard error 0.12 g) of Tea Tree Oil powder was dispensed on to the carpet samples from the standard product pack. The powder and dust samples were left for 3.5 hours and then collected in the same way as the pre-treatment controls. Six replicates were completed with both charged and uncharged powder.

Tests with Carpet Powder Alone Applied to the Carpet Samples

Tests were completed without dust being applied to the carpets to enable calculation of the proportion of carpet powder remaining in the carpet after vacuuming.

The carpet sample was weighed prior to powder application. An average of 2.07 g (standard error 0.087) of charged powder and 2.34 g (standard error 0.15) of uncharged powder was added in the tests. This was left for 3.5 hours and then vacuumed for 1 minute onto an in line glass fibre filter and the weight recorded. Six replicates were completed of each variable.

The percentage of powder recovered was calculated for each individual sample. The average percentage of powder recovered in the charged tests was 85.99% (standard error 1.59%), and 87.47% (standard error 2.23%) in the uncharged tests. These values were used to estimate the mass of powder recovered with the dust samples in the combined experiments. The mass of powder was subtracted from the total mass collected, giving a value for the mass of dust. This was used to calculate the concentration of allergen in the samples and determine any reduction after treatment with tea tree oil carpet powder.

Analysis of Dust Samples for Allergen Concentration 10 ml of 1% Bovine Serum Albumin in Phosphate Buffered Saline with 0.05% Tween (BSA-PBS-T) was added to the 20 ml universal tubes containing the dust covered filters. Samples were vortexed and kept at 4° C. overnight, the filter papers were then removed, leaving as much of the liquid in the tube as possible. 1 ml was then removed from each sample and placed in an Eppendorf tube. The samples were centrifuged for 5 minutes at 13000 rpm, after which the supernatant was removed and placed in a clean Eppendorf tube. An appropriate dilution was then made of the neat sample with 1% BSA-PBS-T. Samples were assayed by a Der pl ELISA test (all antibodies from Indoor Biotechnologies), to determine the allergen content and the 96 well ELISA plate was read using a plate reader (EL×800, Bio-tek Instruments Inc.). Concentration of allergen in the samples was obtained by comparison with a standard curve (standards from Indoor Biotechnologies). This was then related to the mass of dust that had been present in each sample. The amount of allergen expected to be present in a 0.1 g sample of dust was calculated for all the samples. The percentage difference between allergen concentration of the pre-treatment control sample and the exposed test sample was then obtained and compared to the dust alone controls by a Mann-Whitney U-test.

Figure 7:
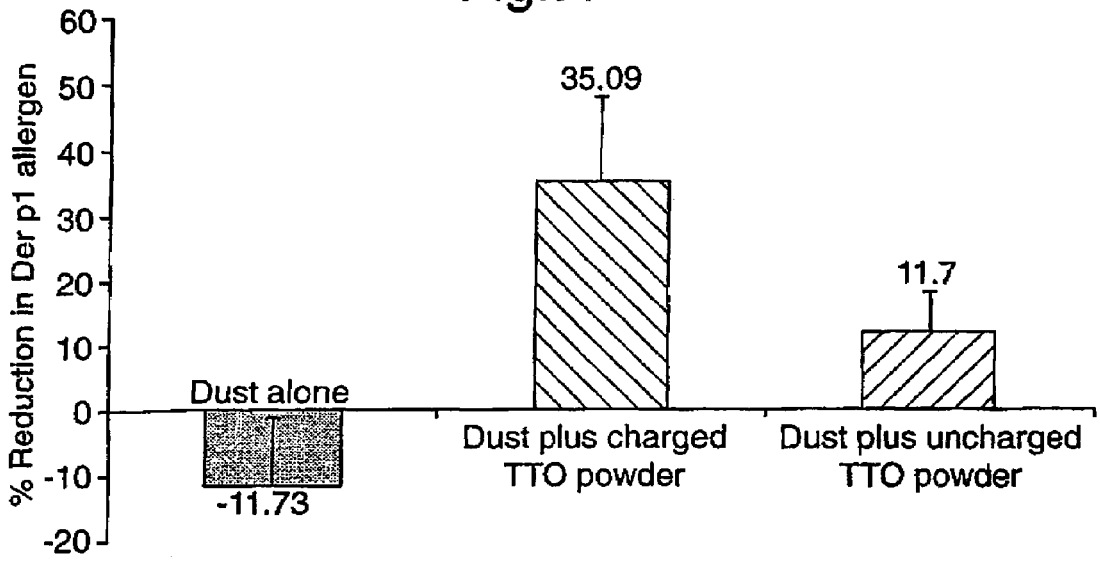
FIG. 7 illustrate the percentage of powder removed from carpet samples as described in Example 4.

The results are given in FIG. 7. It can be seen from this figure that the application of charged tea tree oil carpet powder to the dust on a carpet at 80% RH reduced the Der pl allergen content of the dust by 35.09% (standard error 12.8%) which was a significant reduction (P=0.032) when compared to the dust alone control (mean 11.7%, standard error 10.45%).

The invention claimed is:

1. A powder charging and delivery device which comprises a receptacle having a neck portion, the receptacle containing particles of an electrostatically chargeable material and the receptacle having a reticulated, open pore, foam material disposed within the neck thereof, wherein the foam material has a pore size of about 20 to 65 pores per square inch (ppi) and a length of about 50 to 300 mm, whereby as the particles are dispensed from the container they travel through the pores of the reticulated foam material and thereby become electrostatically charged.

2. A device according to claim 1 wherein the particles comprise celite, maize, cyclodextrin, polyvinylpyrrolidone, polyester, nylon, calcium carbonate (calcite), sodium bicarbonate, sodium carbonate, sodium sesquicarbonate, polyvinyl chloride (PVC), polytetra fluoroethylene, polystyrene, polycarbonate, polyimides and wax materials.

3. A device according to claim 2 wherein the particles comprise calcium carbonate, sodium carbonate, sodium bicarbonate or sodium sesquicarbonate said particles coated with from 0.1 to 2% of an oil.

4. A device according to claim 1 wherein the particles have a mean particle size in the range of from 50 to 500 μm.

5. A device according to claim 4 wherein the particles have a mean particle size in the range of from 100 to 200 μm.

6. A device according to claim 1 wherein the particles are coated with an allergen denaturing composition.

7. A device according to claim 6 wherein the allergen denaturing composition is tea tree oil.

8. A device according to claim 1 wherein the reticulated foam is made of polyether, polyester or polyurethane.

9. A device according to claim 1 wherein the receptacle is fitted with a re-usable cap or a peel-off seal.

10. A device according to claim 1 which is adapted to be refilled with particles of an electrostatically chargeable material.

11. A device according to claim 1 wherein the particles have a charge to mass ratio of at least $\pm 1\times10^{-5}$ C/kg.

12. A device according to claim 11 wherein the particles have a charge to mass ratio of at least $\pm 1\times10^{-4}$ C/kg.

13. A method for removing dust and other fine particulate material from a substrate comprising:

a) charging an electrostatically chargeable particle in a device according to claim 1;

b) applying the charged particles to a substrate to be cleaned, wherein dirt and other particulate materials adhere to the charged particles; and c) removing the charged particles and dirt and particulate material from the substrate.

* * * * *